US007293929B1

(12) United States Patent
Atkinson et al.

(10) Patent No.: US 7,293,929 B1
(45) Date of Patent: Nov. 13, 2007

(54) TOOL FOR APPLYING PINSTRIPING, AND METHOD THEREFOR

(76) Inventors: Philip Lee Atkinson, 1100 Brook Ridge Ave., Allen, TX (US) 75002; Kenneth C. Dingle, III, 17610 W. Strack Dr., Spring, TX (US) 77379

( * ) Notice: Subject to any disclaimer, the term of this patent is extended or adjusted under 35 U.S.C. 154(b) by 0 days.

(21) Appl. No.: 11/369,887

(22) Filed: Mar. 7, 2006

Related U.S. Application Data

(63) Continuation-in-part of application No. 10/912,730, filed on Aug. 5, 2004, now abandoned, which is a continuation of application No. 10/313,159, filed on Dec. 6, 2002, now Pat. No. 6,789,974.

(51) Int. Cl.
*B05C 17/00* (2006.01)
*A46B 11/00* (2006.01)
*B43M 11/06* (2006.01)
*B43K 29/00* (2006.01)

(52) U.S. Cl. ..... 401/208; 401/48; 401/183; 401/193

(58) Field of Classification Search ..... 401/208, 401/48, 193, 183, 218, 219, 220, 124, 135; 118/207, 208
See application file for complete search history.

(56) References Cited

U.S. PATENT DOCUMENTS

| | | | | |
|---|---|---|---|---|
| 1,830,860 | A * | 11/1931 | Scoles | 401/218 |
| 2,582,861 | A * | 1/1952 | Coombs | 401/208 |
| 2,721,347 | A * | 10/1955 | Benkowski | 401/219 |
| 3,448,722 | A * | 6/1969 | Krizman | 118/207 |
| 6,866,716 | B1 | 3/2005 | Montemurro | |

* cited by examiner

*Primary Examiner*—David J. Walczak
(74) *Attorney, Agent, or Firm*—Scheef & Stone, LLP; Jack D. Stone, Jr.

(57) ABSTRACT

A paint striper has a main body having a head portion, an interior cavity, and a slot in fluid communication between the head portion and the interior cavity. The slot is configured for receiving a wheel, and the interior cavity is configured for receiving paint. A wheel is rotatably mounted in the slot with a portion of the wheel extending into the interior cavity. A shoulder extends from the main body, and a guide extends from the shoulder for following a guide track formed in a strip positioned on a surface of the vehicle, wherein the track is substantially parallel to the desired position of the pinstripe. The strip is secured in position on the surface of the vehicle using adhesive which permits removal of the strip from the surface of the vehicle without leaving a residue, and re-use of the strip on a surface of another vehicle.

2 Claims, 15 Drawing Sheets

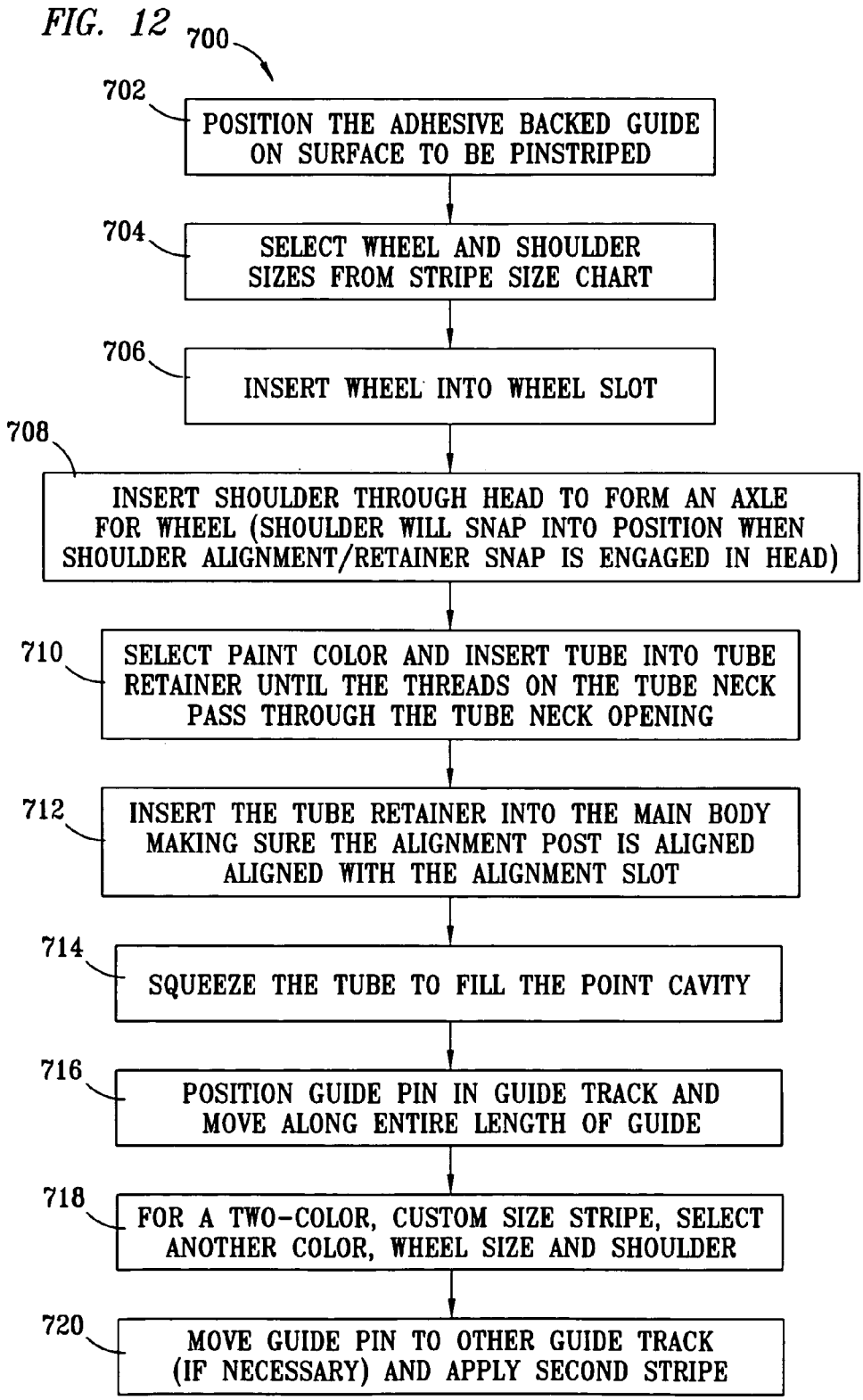
FIG. 12
700
702
POSITION THE ADHESIVE BACKED GUIDE ON SURFACE TO BE PINSTRIPED
704
SELECT WHEEL AND SHOULDER SIZES FROM STRIPE SIZE CHART
706
INSERT WHEEL INTO WHEEL SLOT
708
INSERT SHOULDER THROUGH HEAD TO FORM AN AXLE FOR WHEEL (SHOULDER WILL SNAP INTO POSITION WHEN SHOULDER ALIGNMENT/RETAINER SNAP IS ENGAGED IN HEAD)
710
SELECT PAINT COLOR AND INSERT TUBE INTO TUBE RETAINER UNTIL THE THREADS ON THE TUBE NECK PASS THROUGH THE TUBE NECK OPENING
712
INSERT THE TUBE RETAINER INTO THE MAIN BODY MAKING SURE THE ALIGNMENT POST IS ALIGNED ALIGNED WITH THE ALIGNMENT SLOT
714
SQUEEZE THE TUBE TO FILL THE POINT CAVITY
716
POSITION GUIDE PIN IN GUIDE TRACK AND MOVE ALONG ENTIRE LENGTH OF GUIDE
718
FOR A TWO-COLOR, CUSTOM SIZE STRIPE, SELECT ANOTHER COLOR, WHEEL SIZE AND SHOULDER
720
MOVE GUIDE PIN TO OTHER GUIDE TRACK (IF NECESSARY) AND APPLY SECOND STRIPE

TOOL FOR APPLYING PINSTRIPING, AND METHOD THEREFOR

CROSS-REFERENCE TO RELATED APPLICATION

This application is a continuation-in-part of, and hereby incorporates herein by reference, patent application Ser. No. 10/912,730, entitled "METHOD AND TOOL FOR APPLYING PINSTRIPING", filed on Aug. 5, 2004 now abandoned, on behalf of Philip Lee Atkinson and Kenneth C. Dingle III, which application is a continuation of Ser. No. 10/313,159, filed Dec. 6, 2002, now U.S. Pat. No. 6,789,974, entitled "METHOD AND TOOL FOR APPLYING PINSTRIPING", issued on Sep. 14, 2004, to Philip Lee Atkinson and Kenneth C. Dingle III.

TECHNICAL FIELD

The invention relates generally to pinstriping and, more particularly, to methods and tools for applying pinstriping to vehicles.

BACKGROUND

Purchasers and owners of vehicles, such as automobiles and trucks, often desire to improve the appearance of their vehicle by pinstriping their vehicles, or portions of their vehicles. This may be achieved by manually applying with a paint brush a pinstripe onto the vehicle. It is very difficult though to obtain consistent, high-quality results from manually painting a pinstripe onto a vehicle. Moreover, such technique is also very time-consuming.

In an attempt to improve the quality of pinstripe, a roller device has been developed, as described, for example, in U.S. Pat. No. 1,988,710 entitled "Striper" which issued to Samuel B. Beugler on Jan. 22, 1935, and is described in further detail below with respect to FIGS. 1-5. Such roller device is used in lieu of a brush and includes a removable closure cap having a slot through which a striping wheel rotates in a manner such that all of the paint adhering to the wheel, after it has engaged the surface being pinstriped, is carried back into the barrel. The device further includes a guide bar extending from the device for insertion in a guide track. The guide is preferably magnetic so that it may be positioned on a vehicle with a metallic surface, and includes a groove configured for receiving the guide bar. In operation, the guide bar is positioned in the groove of the guide track, and the device is moved along the guide track as the wheel of the device is rolled with paint along the surface of the vehicle, thereby applying paint to the vehicle in a relatively straight line.

There are a number of drawbacks associated with using the Beugler roller device to apply a pinstripe to the surface of a vehicle. For example, the guide bar is difficult to maintain in the groove of the guide track while moving the device along the track. Furthermore, since the guide relies on magnetism to attach to the vehicle, the strip may not be used with vehicles having non-metallic surfaces, such as fiberglass, composites, and the like.

In another attempt to cure the drawbacks associated with conventional techniques for applying pinstriping, stencils have been developed in which a pinstripe is applied to the surface of a vehicle by painting within the bounds provided by the stencil. There are a number of drawbacks associated with using stencils also. For example, stencils are difficult to use under windy weather conditions, because a stencil will tend to not stay lined up on a vehicle as it should to permit a pinstripe to be applied. A stencil will also tend to bubble up on a hot car surface, permitting paint to bleed through the edges of the pinstripe. A stencil also requires more paint to make a pinstripe than any other method available for pin striping. It is also difficult to make a tip with a stencil, a pinstripe with multiple lines and/or colors, or to remove a stencil from a vehicle without getting paint on any other part of the vehicle. As a result of the foregoing, stencils are relatively time-consuming and more expensive than other methods.

While pinstriping technology has evolved, substantial skill, experience, and time is still required to apply a pinstripe to a vehicle with consistent high-quality. Accordingly, a continuing search has been directed to the development of methods and tools by which people, with or without substantial experience, may apply pinstriping to a vehicle in a reasonable amount of time with consistent high-quality.

SUMMARY

The present invention, accordingly, provides an improved pin striping tool and method having a main body comprising a head portion, an interior cavity, and a slot in fluid communication between the head portion and the interior cavity. The slot is configured for receiving a wheel, and the interior cavity is configured for receiving paint. A wheel is rotatably mounted in the slot with a portion of the periphery of the wheel extending into the interior cavity. A shoulder extends from the main body, and a guide extends from the shoulder, the guide being configured for following a guide track formed in a strip positioned on a surface of the vehicle, wherein the track is substantially parallel to the desired position of the pinstripe.

In a further embodiment, the strip is secured in position on the surface of the vehicle using adhesive which permits removal of the strip from the surface of the vehicle without leaving a residue, and re-use of the strip on a surface of another vehicle.

In a still further embodiment of the invention, a shoulder is configured having a square cross-section to inhibit movement of the shoulder relative to the head.

In a still further embodiment of the invention, guide arms are integrated with the striper tool.

In a still further embodiment of the invention, guide arms are integrated with a sheath that fits over the striper tool.

In a still further embodiment of the invention, guide arms have a square cross-section and inserted into square holes to thereby inhibit movement of the guide arm relative to the striper tool.

In a still further embodiment of the invention, a guide is used in conjunction with a finger pad to controlling manual application of a pin stripe.

In a still further embodiment of the invention, foam tape is utilized to removably secure a guide in position on the surface of a vehicle.

BRIEF DESCRIPTION OF THE DRAWINGS

For a more complete understanding of the present invention, and the advantages thereof, reference is now made to the following description taken in conjunction with the accompanying drawings, in which:

FIG. 12 is a flowchart of steps for applying a pinstripe in accordance with the present invention;

DETAILED DESCRIPTION

Figure 1:
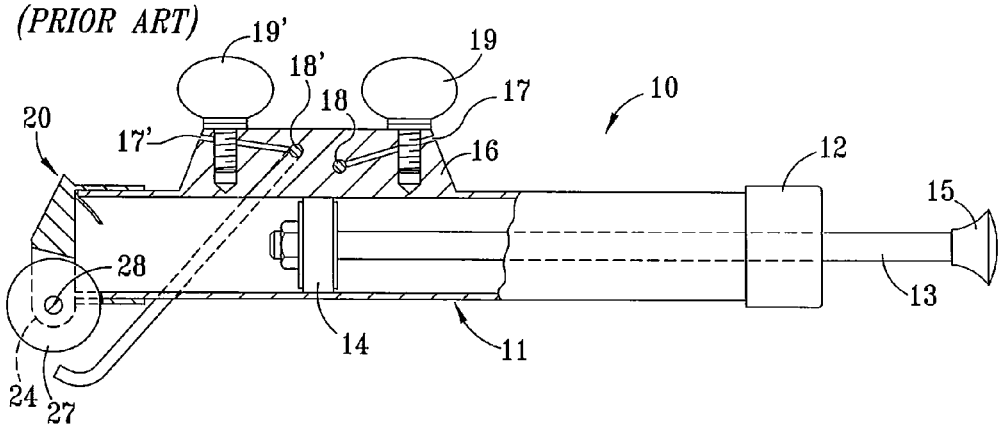
FIG. 1 (PRIOR ART)
FIG. 1 is a side elevation with parts broken away showing a prior art striper.

In the following discussion, numerous specific details are set forth to provide a thorough understanding of the present invention. However, it will be obvious to those skilled in the art that the present invention may be practiced without such specific details. In other instances, well-known elements have been illustrated in schematic or block diagram form in order not to obscure the present invention in unnecessary detail. Additionally, for the most part, details concerning paint and the like have been omitted inasmuch as such details are not considered necessary to obtain a complete understanding of the present invention, and are considered to be within the skills of persons of ordinary skill in the relevant art.

Refer now to the drawings wherein depicted elements are, for the sake of clarity, not necessarily shown to scale and wherein like or similar elements are designated by the same reference numeral through the several views.

Referring to FIG. 1 of the drawings, the reference numeral 10 generally designates a striper embodying features of the prior art, namely, U.S. Pat. No. 1,988,710 to Beugler, referenced above. The striper 10 includes barrel or tube 11 which has a closure 12 on one end through which a plunger rod 13 slidably extends. The plunger rod 13 is provided with a plunger 14 within the barrel and has a button 15 on its outer end. Reference numeral 16 indicates an embossed portion formed on the top of the barrel, such portion being provided with a pair of oppositely disposed slots 17 and 17', which are enlarged at their inner ends for the reception of guide bars 18 and 18'. The guide bars are locked in the slots by means of thumb screws 19 and 19'. It will be understood that various types of guide bars may be employed, depending upon the work in connection with which the device is used, the use of such guide bars being well known to those familiar with the art.

Reference number 20 indicates a cap or head which is shown as comprising a collar 21 fitted over the open end of the barrel 11 and an end closure 22. The end closure plate 22 is preferably made of appreciable thickness or, as shown, is provided with a forwardly extending lug or boss 23 which has a downwardly extending projection 24. This projection 24 provides a convenient means for guiding the striper with an ordinary "straight edge" or ruler, and is an important feature of the device 10. The cap or head 20 is provided in its bottom portion with a slot, such slot having a portion 25 extending into the collar flange 21 and another portion 26, just referred to, communicates with the interior of the barrel and contains a striping wheel plate 27 which is rotatably mounted in this slot upon a pin 28 which in turn is mounted in the lower bifurcated end portion 24 of the boss 23. This wheel plate may be of any desired width, depending on the width of the strip desired, and its periphery may be knurled as is well known to those familiar to the art. The radius of the wheel, however, must be such that it has a segment extending through the two slots portions 25 and 26 into the interior of the barrel.

Figure 2:
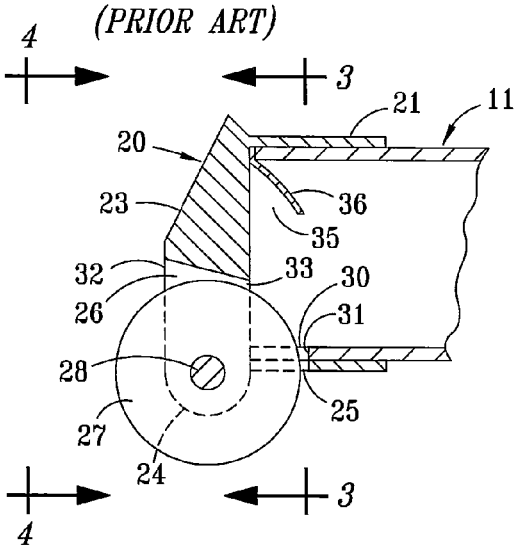
FIG. 2 (PRIOR ART)
FIG. 2 is an enlarged partial section further illustrating the construction of the cap or spring head contemplated by the prior art depicted in FIG. 1.
Figure 3:
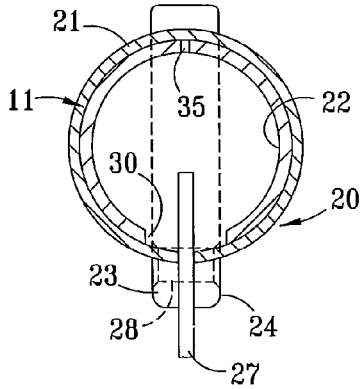
FIG. 3 (PRIOR ART)
FIG. 3 is a sectional elevation taken on the line 3-3 of FIG. 2.
Figure 5:
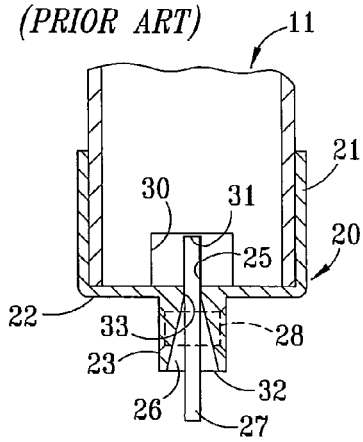
FIG. 5 (PRIOR ART)
FIG. 5 is a plan section taken on the line 5-5 of FIG. 4.

For the purpose of admitting the segment of the wheel extending into the barrel, as just pointed out, the end of the barrel is provided with a notch indicated at 30. In order that the paint withdrawn from the barrel by the wheel during its rotation may be confined, as far as possible, to the edge of the wheel, the slot portion 25 is formed in the collar flange 21 so that its sides are in substantial sliding engagement with the face of the wheel. The depth of this slot, however, is such that its inner end 31 is spaced a slight distance away from the periphery of the wheel. These two features are best illustrated in FIGS. 2, 3, and 5.

Figure 4:
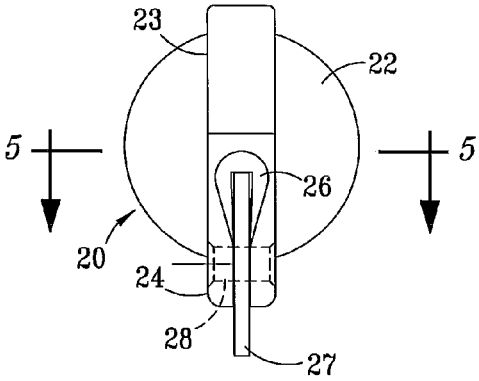
FIG. 4 (PRIOR ART)
FIG. 4 is an end elevation taken in the direction of the arrow 4 in FIG. 2.

The primary object of this striper 10 is to form a head construction so that all of the paint adhering to the wheel after it has engaged the surface being striped is carried by the wheel back into the barrel instead of being wiped off by the edges of the slot whereby the dripping of paint onto the work, which occurs in the conventional striper, is eliminated. This is accomplished by forming the upper part of the slot portion 26 through which the wheel rotates in passing into the barrel of a width and shape such that a substantial space surrounds both the edge and the side surfaces of the wheel when it is rotating into the barrel. It has been found that for the most satisfactory operation, it is important that the slot portion 26 be made substantially larger at its outer edge 32 than it is at its inner edge 33 where the wheel rotates into the barrel. In other words, it is important that the wall of the slot diverge outwardly away from the inner edge or inner end 33 thereof. It is also important, as pointed out above, that the portion of the slot which is adjacent the lower half of the wheel, or adjacent that portion of the wheel which is rotating away from the barrel, be in substantial sliding engagement with the side faces of the wheel, and it is therefore necessary that, in addition to diverging outwardly from the inner end 33, the slot portion 26 must also converge downwardly toward the axis of the wheel. The first feature mentioned above is best illustrated in FIGS. 2 and 5, and the last mentioned feature is best illustrated in FIG. 4.

In addition to the slot construction just described, is has been previously pointed out that the striper 10 also contemplates means for frictionally holding the cap or head member on the barrel. This last mentioned means constitutes a spring finger 35 which is formed on the end of the barrel by a short helical kerf 36.

In the operation of this device, the plunger 14 is withdrawn to the desired point in the barrel, the cap or head 20 is removed, and the desired quantity of paint or lacquer is poured into the barrel. A striping head having a wheel of the desired width is then placed over the open end of the barrel; the plunger is pressed forward to bring the paint into slight pressure contact with the interior of the striping head. Guides of the desired type are then set to the position required and the device is drawn along the object to be striped so as to rotate the "inside" segment of the striping wheel downwardly out of the barrel. In this manner the paint is carried by capillary or viscosity action along the edge of the wheel and is applied to the surface being striped. Any paint which adheres to the wheel after it traverses the surface is carried back into the barrel, since there is no way in which it can be wiped off or drip onto and spoils the work. The plunger may be compressed from time to time by the application of pressure on the button 15 in a manner well known to those familiar with the art.

Figure 6:
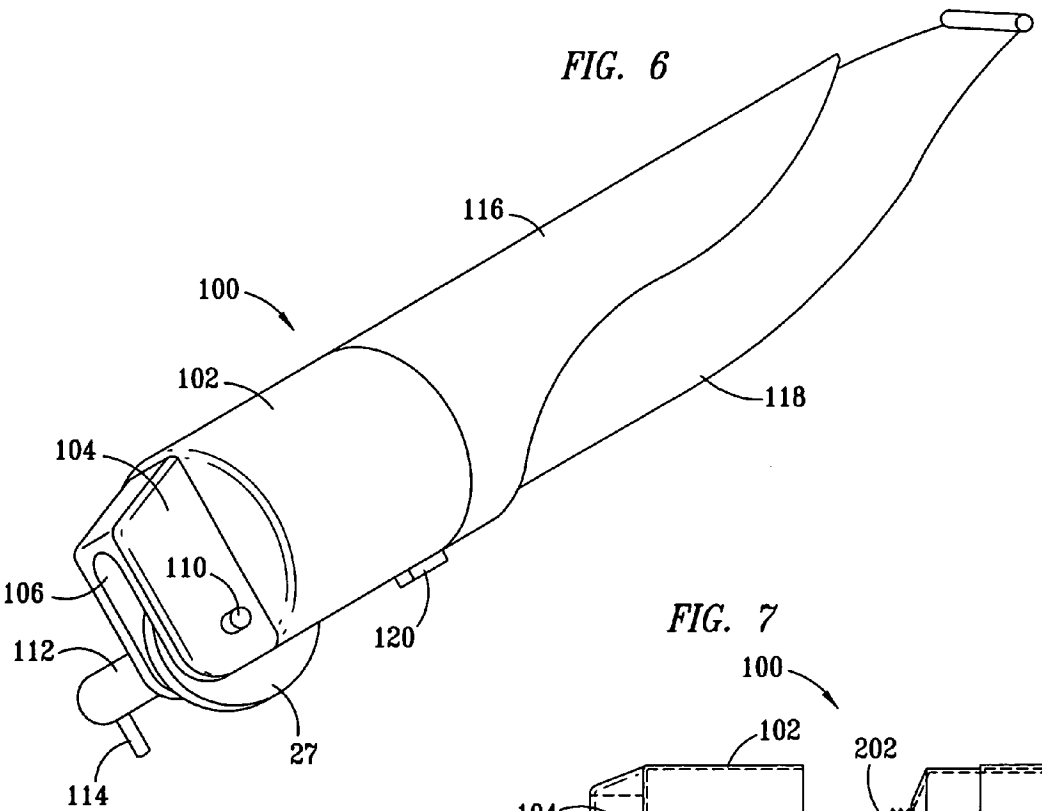
FIG. 6 is a perspective view of a pin striping tool embodying features of the present invention.

Referring to FIG. 6 of the drawings, the reference numeral 100 generally designates a pinstriping tool embodying features of the present invention. As described in further detail below, the tool 100 includes a main body 102 comprising a head 104. The head 104 defines an opening 106 and a slot (not shown in FIG. 6) formed therein and configured for receiving a wheel 27. The wheel 27 is rotatably secured therein via an axle 110 extending from a shoulder 112 positioned in the head 104. A guide pin 114 extends downwardly (as viewed in FIG. 6) from the shoulder 112 for insertion in a guide track (shown and discussed below with respect to FIGS. 9-11). The main body 102 is further configured for receiving a tube retainer 116. The tube retainer 116 is configured for holding a tube 118 containing paint to be applied to form a pinstripe on a surface of a vehicle (not shown in FIG. 6). The tube retainer 116 also includes a post 120 configured for mating with a corresponding alignment slot (not shown in FIG. 6). While the post 120 and corresponding alignment slot are preferred, the pinstriping tool 100 may optionally be fabricated without them.

Figure 7:
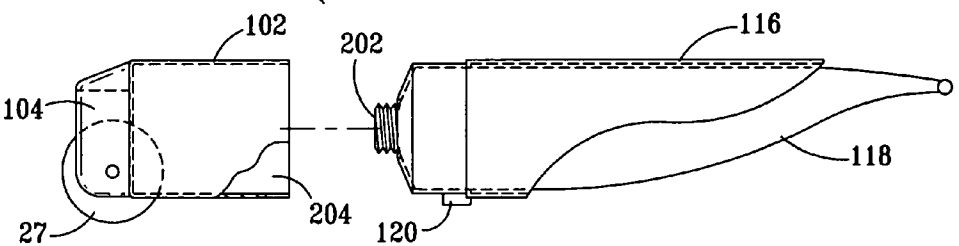
FIG. 7 is a side elevation view of the tool of FIG. 6.

FIG. 7 shows a side elevation view of the pinstriping tool 100 of FIG. 6, with the tube retainer 116 removed. As shown therein, the tube of paint 118 includes a tube neck 202 which extends into a cavity 204 of the main body 102 for facilitating the communication of paint from the tube 118 to the main body 102.

Figure 8:
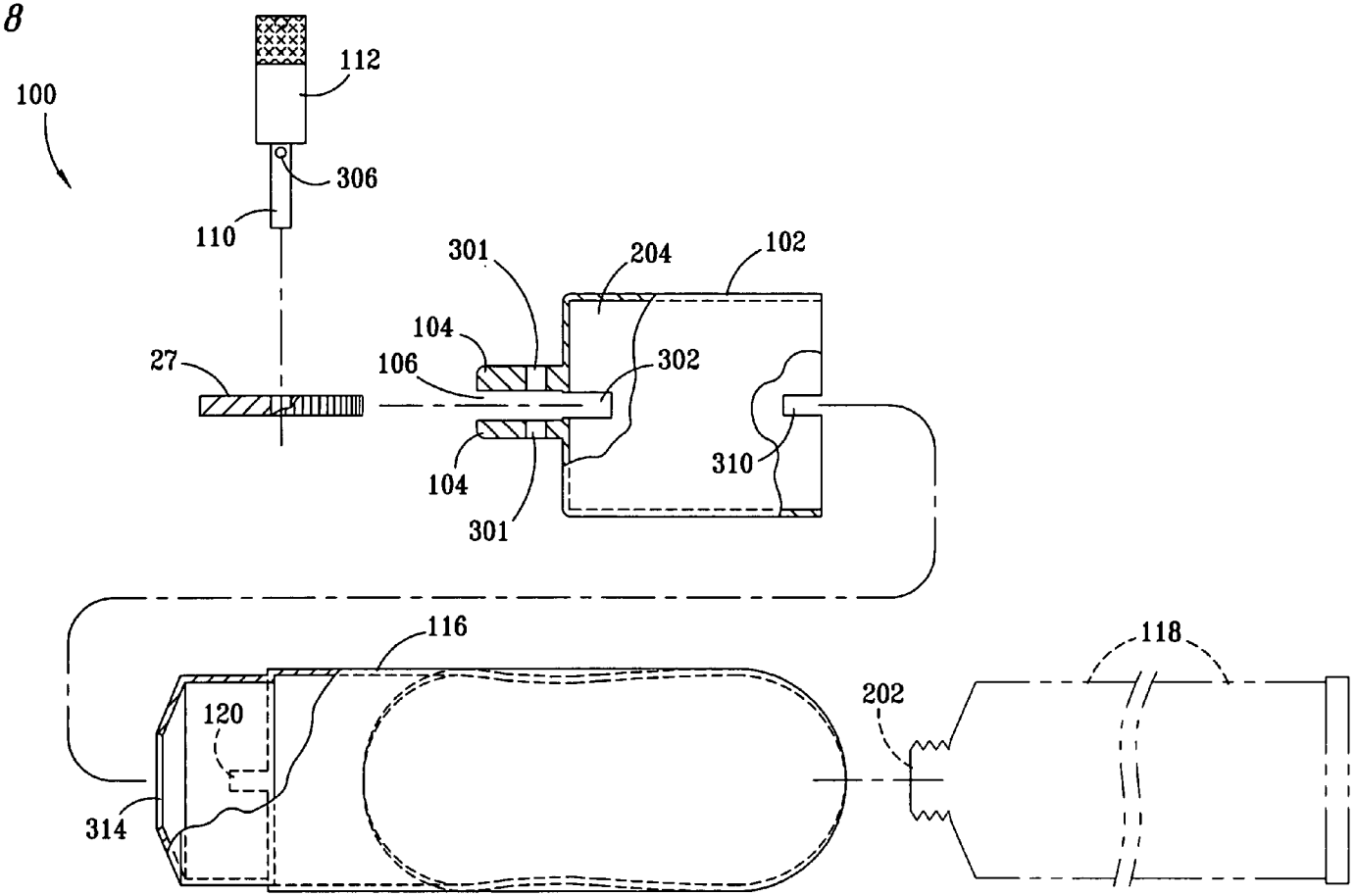
FIG. 8 is an exploded view of the tool of FIG. 6.

FIG. 8 shows an exploded view of the pinstriping tool 100. As shown, the head portion 104 includes a race opening 301 configured for receiving the axle 110. The axle 110 includes a raised portion 306 configured for snapping into a corresponding detent 308 formed in the race opening 301 for securing the axle 110 in the race opening 301. As depicted in FIG. 8, a slot 302 is defined by the head 104 through which a portion of the periphery of the wheel 27 extends into the cavity 204. An alignment slot 310 is formed in the main body 102 for receiving the post 120. The tube retainer 116 defines a tube neck opening 314 for receiving the tube neck 202.

Figure 9:
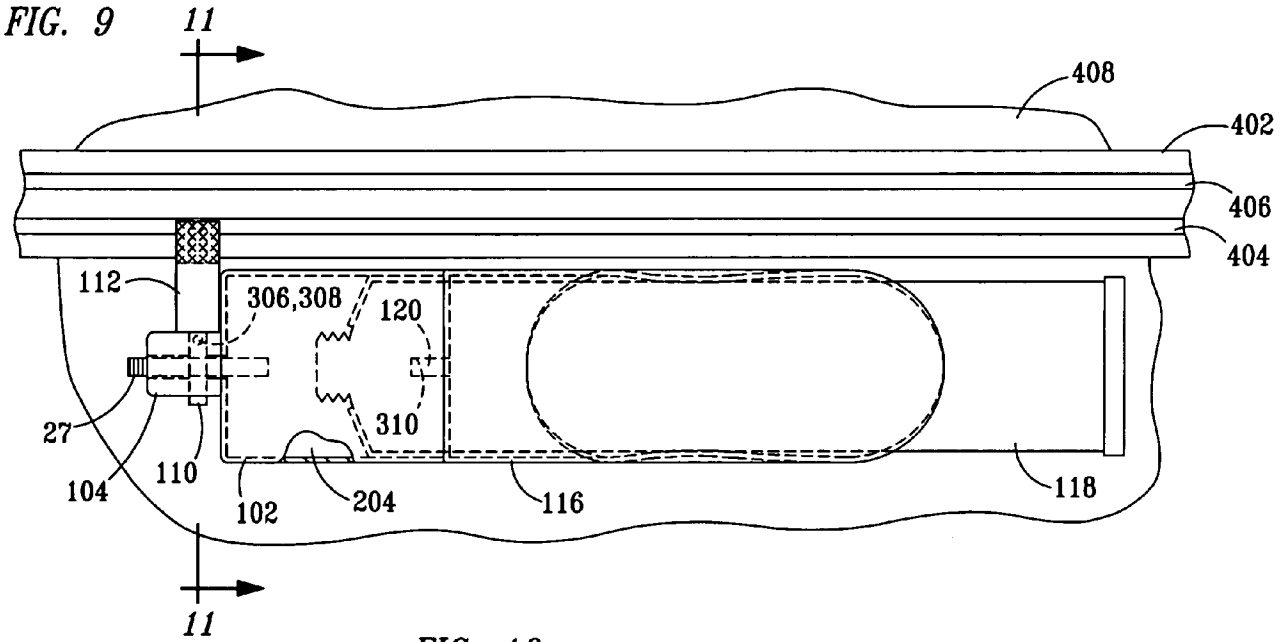
FIG. 9 is a plan view of the tool of FIG. 6 shown in operation.
Figure 10:
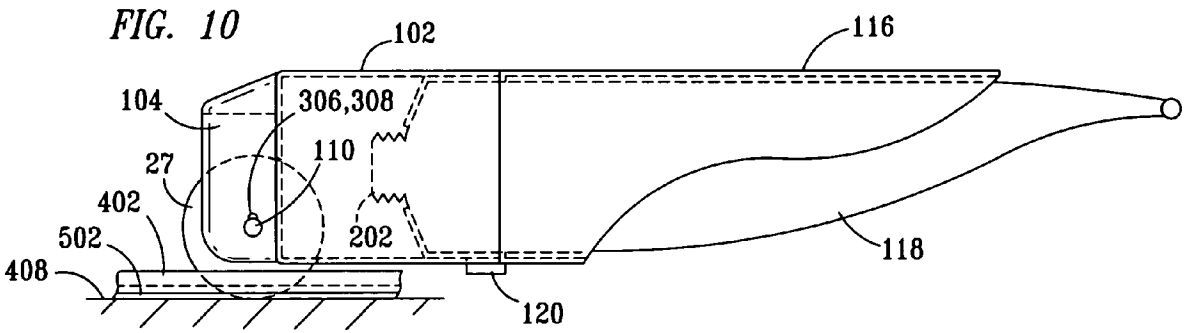
FIG. 10 is a side elevation view of the tool of FIG. 9.
Figure 11:
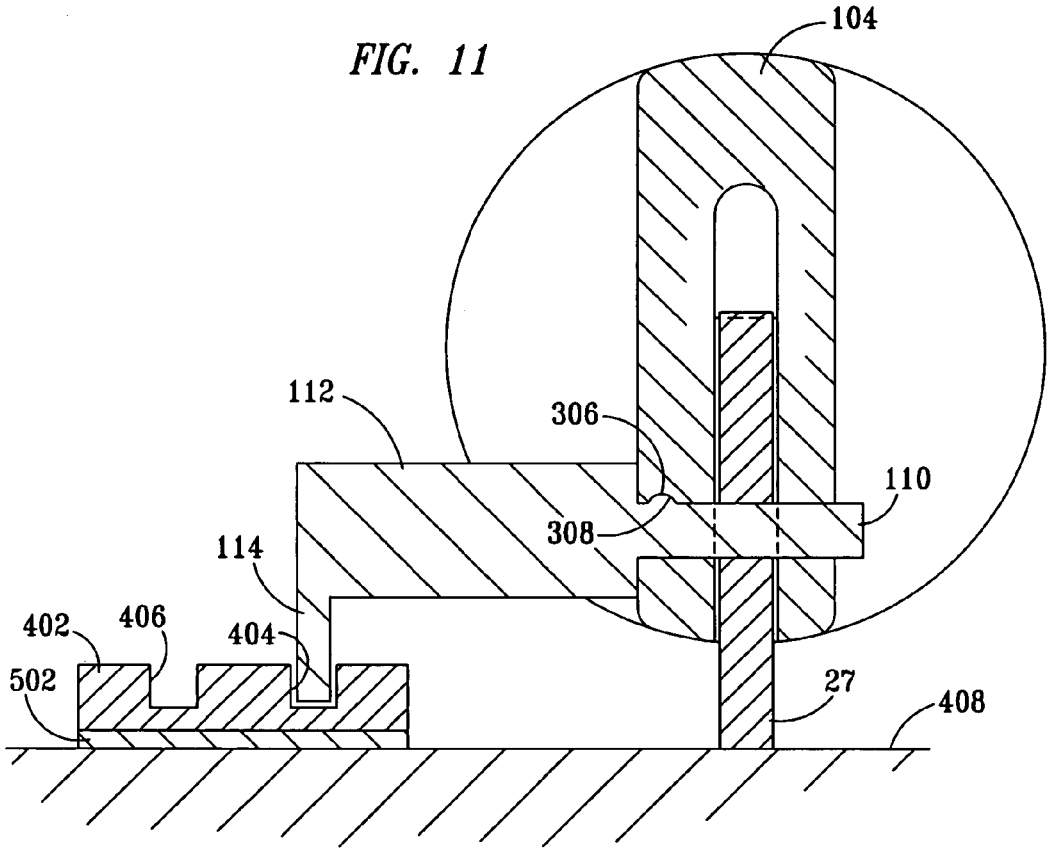
FIG. 11 is a front elevation view of the tool of FIG. 9.

FIGS. 9-11 exemplify how the pinstriping tool 100 may be set up for operation. Preferably, an adhesive-backed guide 402 is positioned on a surface 408 of a vehicle. The guide 402 preferably includes a double sided adhesive strip 502 that is effective within a temperature range of from 40°-160° F. for adhering the guide 402 to a surface of a vehicle, and for being removed from the vehicle surface without leaving a residue, so that it may be re-used on a surface of another vehicle (not shown). By way of example, such an adhesive strip 502 is commercially available from PluStar™, located in Dallas, part number 14375. The guide 402 preferably includes two tracks 404 and 406, such as grooves or ridges, formed therein for allowing the guide pin 114 to ride therein. Optionally, the guide 402 may include only a single track 404 for facilitating work in tight-fitting areas, such as under door mirrors, and the like, wherein multiple spaced-apart pinstripes may be applied by using multiple guide pins 114 extending from shoulders 112 of varying lengths. Alternatively, the guide 402 may include multiple tracks, such as three or four tracks similar to the tracks 404 and 406, to permit a single guide pin 114 and shoulder 112 to be used in the application of a corresponding number of spaced-apart pinstripes, thereby rendering it unnecessary to switch out guide pins 114 and shoulders 112 of varying lengths for each of multiple pinstripes.

Steps of operating the pin-striping tool 100 are depicted in FIG. 12. At step 702, the guide 402 is positioned on the surface 408 via the adhesive-backed strip 502. At step 704, a wheel 27 and shoulder 112 are selected, preferably using a pinstripe size chart (not shown). At step 706, the wheel 27 is inserted into the opening 106 and slot 302 and, at step 708, is secured in place by inserting the axle 110 through the opening 106 until the raised portion 306 snaps into place in the corresponding detent 308 of the race opening 301.

At step 710, a paint color is selected and a tube 118 of paint of such color is inserted into the tube retainer 116 until the tube neck 202 passes through the tube neck opening 314. At step 712, the tube retainer 116 is positioned into the main body 102, such that the alignment post 120 is preferably received by the alignment slot 310. At step 714, the tube 118 of paint is manually squeezed until paint is communicated into the cavity 204.

At step 716, the tool 100 is positioned on the vehicle surface 408 so that the guide pin 114 aligns with the track 404, and the wheel 27 touches the surface 408. The tool 100 is then moved with the guide pin following the track 404, and the wheel 27 rotating and carrying paint from the cavity 204 to the surface 408, thereby forming a pinstripe on the vehicle surface 408. In accordance with step 718, the steps 702-716 may be repeated, but with a paint of a different color and/or a different wheel 27 and/or size of shoulder 112. In accordance with step 720, the steps 702-718 may be repeated using a different track, such as a track 406 to apply a pinstripe spaced-apart from a pinstripe applied using the track 404. If the guide 402 includes any additional tracks (not shown) similar to the tracks 404 and 406, then the steps 702-718 may be similarly repeated to apply additional pinstripe using the additional tracks.

Figure 13:
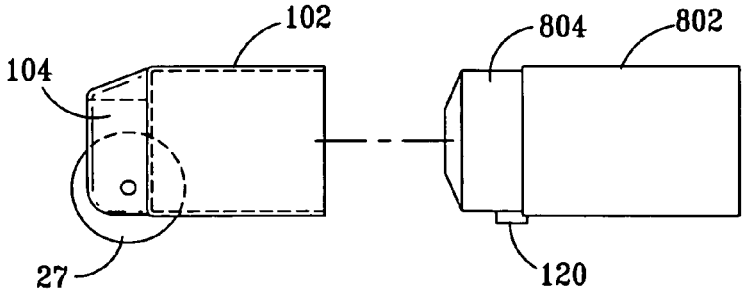
FIG. 13 is an alternate embodiment of the present invention.

The embodiment of FIG. 13 is similar to the embodiment of FIGS. 6-11, and identical components are given the same reference numerals. According to the embodiment of FIG. 13, a tube retainer 804 is adapted for receiving a solid stick of paint 802 which is communicated (e.g., via a plunger, not shown, at one end of the tube) into the cavity 204. Operation of the embodiment of FIG. 13 is otherwise performed in accordance with the steps depicted above with respect to FIG. 12.

Figure 14:
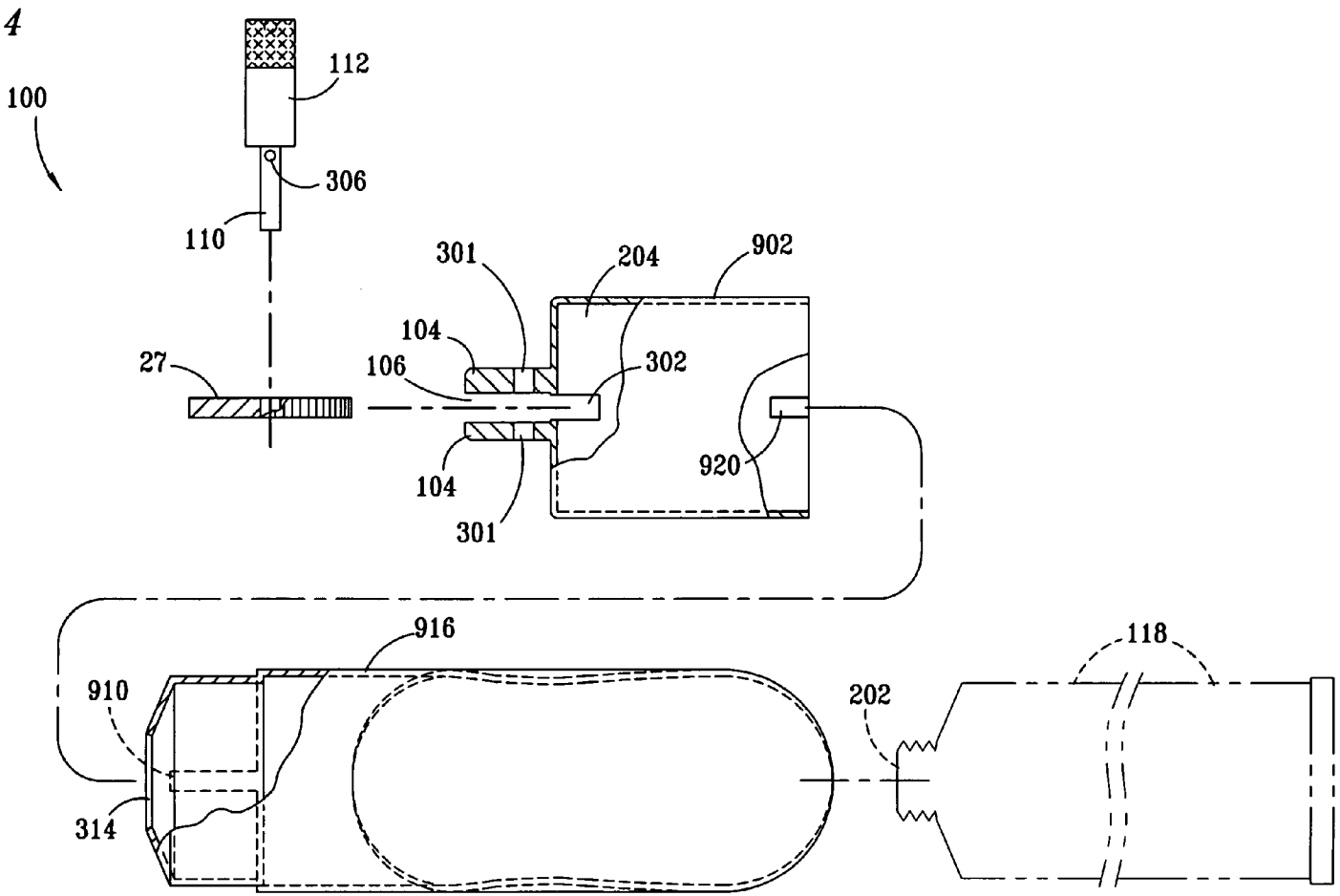
FIG. 14 is a second alternate embodiment of the present invention.

The embodiment of FIG. 14 is similar to the embodiment of FIGS. 6-11, and identical components are given the same reference numerals. According to the embodiment of FIG. 14, a post 920 (similar to post 120) is formed on the main body 902 (otherwise similar to the main body 102) to thereby replace the slot 310, and a slot 910 (similar to slot 310) is formed in a tube retainer 916 (otherwise similar to tube retainer 116) to thereby replace the post 120. The slot 910 and post 920 are matingly configured. Operation of the embodiment of FIG. 14 is otherwise performed in accordance with the steps depicted above with respect to FIG. 12.

The following embodiments depicted in FIGS. 15-39 may generally be adapted in any combination with the foregoing embodiments of FIGS. 1-14.

Figure 15:
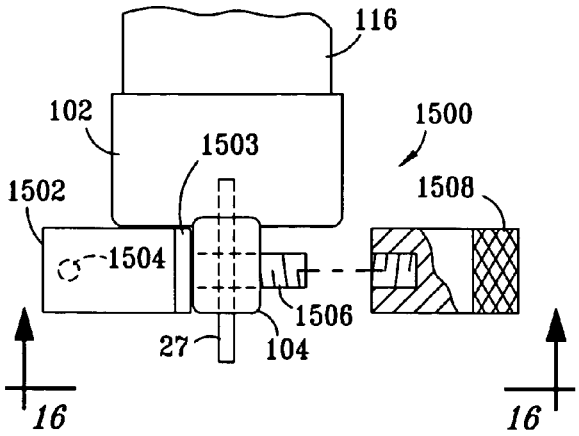
FIG. 15 is a plan view of an alternate embodiment of the invention utilizing a substantially square shoulder.
Figure 17:
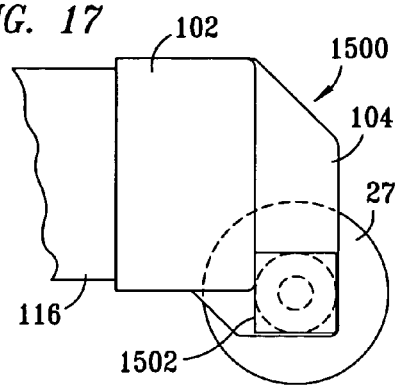
FIG. 17 is a side elevation view of the embodiment of FIG. 15 taken along the line 17-17 of FIG. 16.
Figure 16:
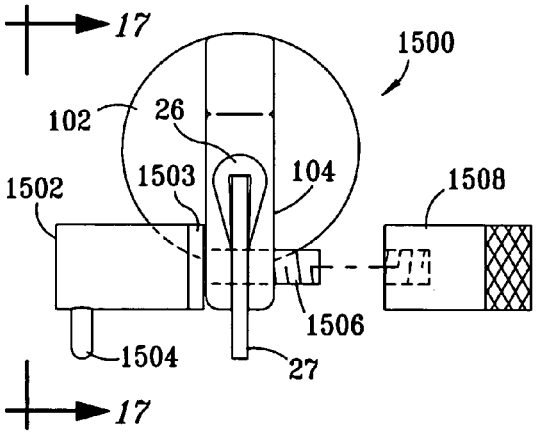
FIG. 16 is an end elevation view of the embodiment of FIG. 15 taken along the line 16-16 of FIG. 15.

The embodiment of FIGS. 15-17 is similar to the embodiments of FIGS. 1-14, and identical components are given the same reference numerals. However, according to the embodiment of FIGS. 15-17, the wheel 27 is rotatably secured in the opening 106 via an axle 1506 extending from a shoulder 1502 positioned in the head 104. A guide pin 1504 extends downwardly (as viewed in FIG. 16) from the shoulder 1502 for matingly engaging a guide (exemplified above with respect to FIGS. 9-11). The axle 1506 is threaded for engaging a knurled nut 1508. As shown in FIG. 17, the shoulder 1502 is configured with flat sides that abut the main body 102 and head 104 for substantially precluding rotation of the shoulder about the axle 1506, and permitting the nut 1508 to be tightened onto the threaded axle. One or more shims 1503 may optionally be provided to extend the length of the shoulder 1502. In the operation of the embodiment of FIGS. 15-17, the shoulder 1502 is secured to the head 102 via the nut 1508, with or without the shims 1503, and operation is otherwise performed in accordance with the steps depicted above with respect to the embodiments of FIGS. 1-14. By use of the embodiment of FIGS. 15-17, the guide pin 1504 may be more readily maintained in a perpendicular orientation relative to the tool 1500, thereby permitting a straighter, more uniform and consistent pin stripe to be made and duplicated.

Figure 18:
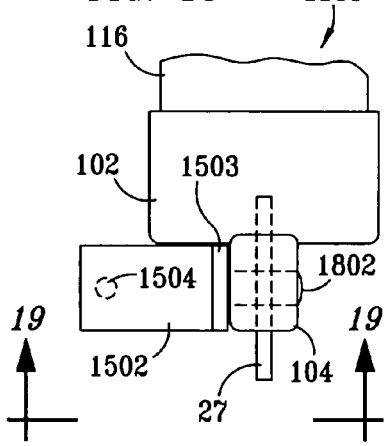
FIG. 18 is a plan view of an alternate embodiment of the invention utilizing a press-fitted pin to hold the shoulder in place.
Figure 19:
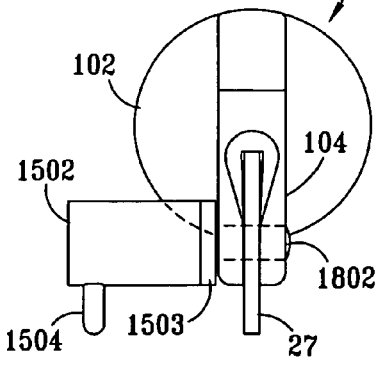
FIG. 19 is an end elevation view of the embodiment of FIG. 18 taken along the line 19-19 of FIG. 18.
Figure 20:
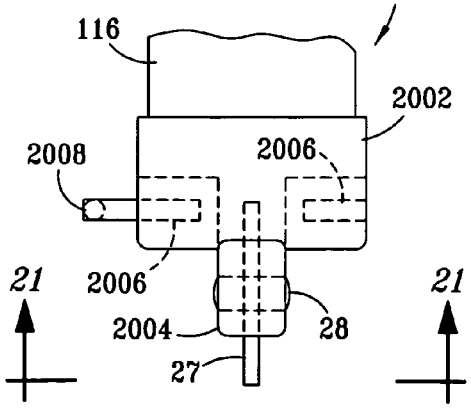
FIG. 20 is a plan view of an alternate embodiment of the invention utilizing insertable guide arms.
Figure 21:
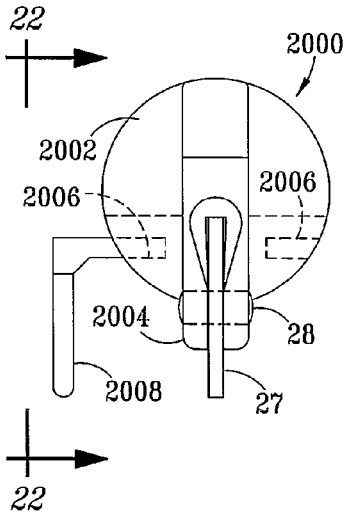
FIG. 21 is an end elevation view of the embodiment of FIG. 20 taken along the line 21-21 of FIG. 20.
Figure 22:
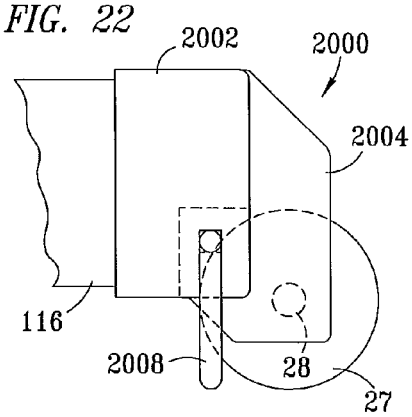
FIG. 22 is a side elevation view of the embodiment of FIG. 20 taken along the line 22-22 of FIG. 21.
Figure 23:
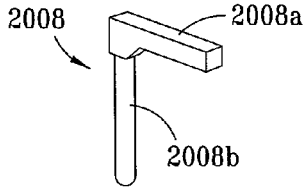
FIG. 23 is a perspective view of a guide arm adapted for use with the embodiment of FIGS. 20-22.

The embodiment of FIGS. 18-19 is similar to the embodiments of FIGS. 15-17, and identical components are given the same reference numerals. However, according to the embodiment of FIGS. 18-19, the shoulder 1502 is secured to the head 104, and the wheel 27 is rotatably secured in the opening 106, via an axle 1802 extending from the shoulder 1502 through the head 104, and press-fitted into the head 104, as described above with respect to FIGS. 1-5. Operation of the embodiment of FIGS. 18-19, is otherwise substantially similar to the operation of the embodiment of FIGS. 15-17.

The embodiment of FIGS. 20-23 is similar to the embodiments of FIGS. 15-17, and identical components are given the same reference numerals. According to the embodiment of FIGS. 20-23, the wheel 27 is preferably rotatably secured in the opening 106 via the pin 28, described above with respect to FIGS. 1-5. The main body 2002 defines one or, preferably two opposing, substantially horizontal (as viewed in FIG. 21) square hole(s) 2006 configured for receiving a guide pin 2008. As shown most clearly in FIG. 23, the guide pin 2008 preferably comprises a first portion **2008*a* having a square cross-section sized for insertion into the hole 2006, and a second portion 2008*b* substantially perpendicular to the portion 2008*a* and configured for matingly engaging a guide (exemplified above with respect to FIGS. 9-11). Alternatively, the holes 2006 may be angled off from horizontal, or even be vertical, and the angle between the portions 2008*a* and 2008*b* adjusted accordingly or reconfigured as three members, so that the portion 2008*b* will be maintained substantially vertically. In another alternative, the holes 2006 and mating portion 2008*a* may comprise any non-circular cross-section, such as a triangle, a star-shape, or the like, effective for inhibiting rotation of the portion 2008*b* while matingly engaging a guide. In operation, the guide pin 2008 is inserted into a hole 2006, and operation is otherwise substantially similar to the operation of the embodiment of FIGS. 1-17**.

Figure 24:
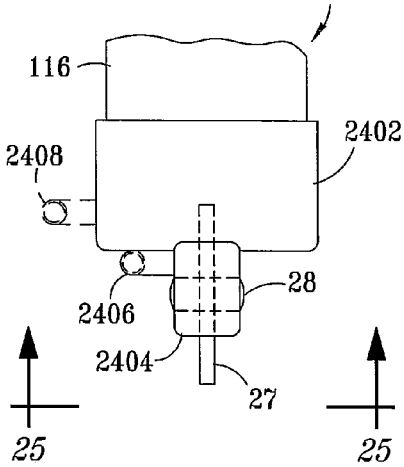
FIG. 24 is a plan view of an alternate embodiment of the invention utilizing a guide arm integral with the tool.
Figure 25:
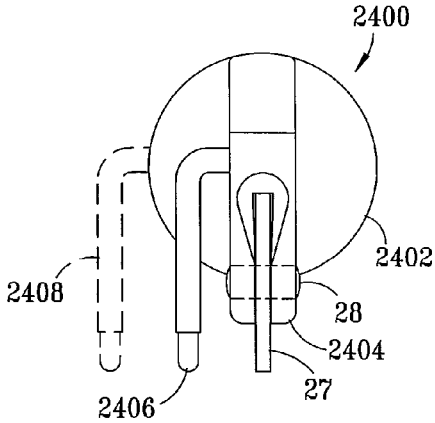
FIG. 25 is an end elevation view of the embodiment of FIG. 24 taken along the line 25-25 of FIG. 24.

The embodiment of FIGS. 24-25 is similar to the embodiment of FIGS. 20-23, and identical components are given the same reference numerals. According to the embodiment of FIGS. 24-25, a guide arm 2406 is preferably integrated (e.g., molded or cast as one piece) with the head 2404, or alternatively, a guide arm 2408 is integrated (e.g., cast as one piece) with the main body 2402. As viewed most clearly in FIG. 25, the guide pin 2408 is preferably configured having a substantially vertical portion configured for matingly engaging a guide (exemplified above with respect to FIGS. 9-11). Apart from installing a guide arm, operation of the embodiment of FIGS. 24-25 is substantially similar to the operation of the embodiment of FIGS. 1-23.

Figure 26:
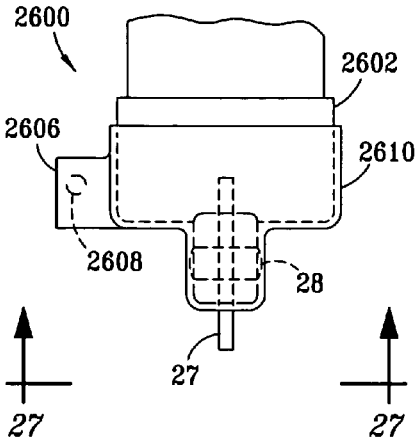
FIG. 26 is a plan view of an alternate embodiment of the invention utilizing a guide arm integral with the tool.
Figure 27:
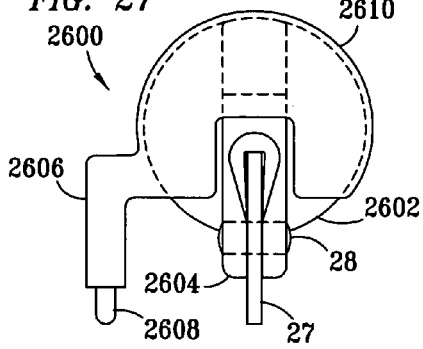
FIG. 27 is an end elevation view of the embodiment of FIG. 26 taken along the line 27-27 of FIG. 26.

The embodiment of FIGS. 26-27 is similar to the embodiment of FIGS. 24-25, and identical components are given the same reference numerals. According to the embodiment of FIGS. 26-27, a guide arm 2606 is integrated (e.g., cast as one piece) with a sheath 2610 configured to envelop the main body 2602. The guide arm 2606 includes a guide pin 2608 configured for matingly engaging a guide (exemplified above with respect to FIGS. 9-11). In operation, the sheath 2610 is positioned over the main body 2602, and operation is otherwise substantially similar to the operation of the embodiment of FIGS. 1-25.

Figure 28:
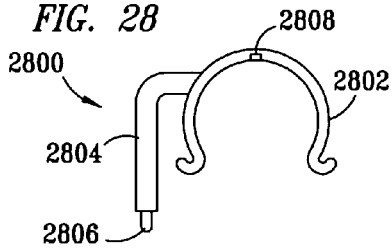
FIG. 28 is an elevation view of a clip-on guide arm.

The embodiment of FIG. 28 is similar to the embodiment of FIGS. 26-27. According to the embodiment of FIG. 28, a clip 2802, fabricated from a flexible material such as metal, is sized for fitting over the body of the striping tool, such as exemplified by the barrel 11, collar 21, main body 102, or the like. A guide arm 2804 extends from the clip 2802 to a guide pin 2806 configured for matingly engaging a guide (exemplified above with respect to FIGS. 9-11). Additionally, the clip 2802 preferably defines an alignment slot 2808 for mating with a tab on a striping tool, such as the tab 2908 described below with respect to FIGS. 29-30, but for the guide arm 2904. In operation, the clip 2802 is positioned over the striping tool, and preferably aligned on the tool via the slot 2808, and operation is otherwise substantially similar to the operation of the embodiment of FIGS. 1-27.

Figure 29:
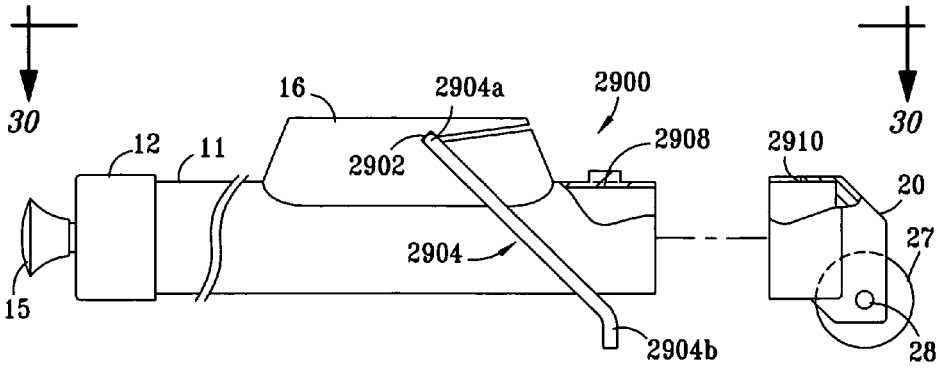
FIG. 29 is a side elevation view of an alternate embodiment of the striper tool of FIGS. 1-5, utilizing a non-circular insertion portion.
Figure 30:
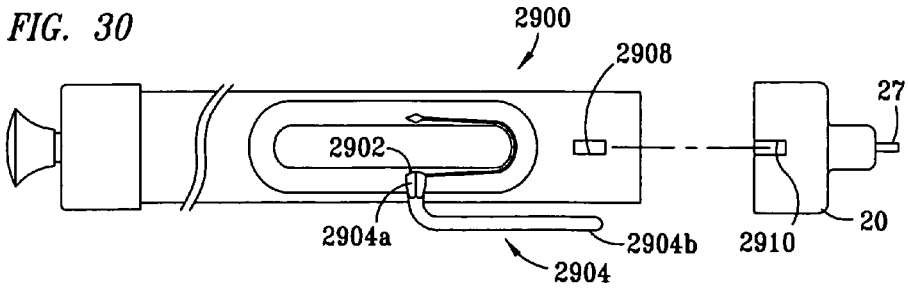
FIG. 30 is a plan view of the embodiment of FIG. 29 taken along the line 30-30 of FIG. 29.

The embodiment of FIGS. 29-30 is similar to the embodiment of FIGS. 1-5, and identical components are given the same reference numerals. According to the embodiment of FIGS. 29-30, the embossed portion 16 formed on top of the barrel 11 defines a hole 2902 having a non-circular cross-section, such as, by way of example but not limitation, a square, triangle, star shape, or the like. A guide arm 2904 is configured at one end 2904*a* having a cross-section configured for matingly engaging the hole 2902, and at an opposing end 2904*b* to define a guide pin configured for matingly engaging a guide (exemplified above with respect to FIGS. 9-11). Optionally, an alignment tab 2908 is formed on the barrel 11, and a slot 2910 is defined in the head 20 for matingly engaging the tab 2908 and aligning the head with the barrel when the head is positioned on the barrel. In operation, the head 20 is positioned and aligned on the barrel 11, and the end 2904*a* is inserted into the hole 2902 so that the end 2904 of the guide sheath 2610 is positioned over the main body 2602, and operation is otherwise substantially similar to the operation of the embodiment of FIGS. 1-27.

Figure 31:
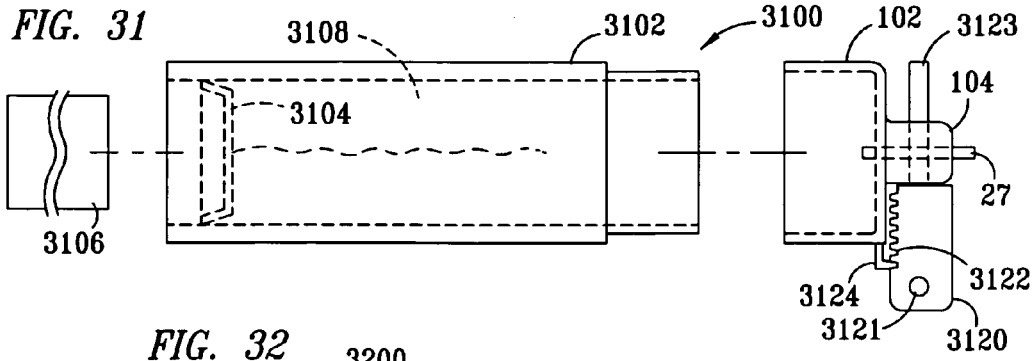
FIG. 31 is a plan view of an alternate embodiment of the invention utilizing a ratcheted guide arm.
Figure 32:
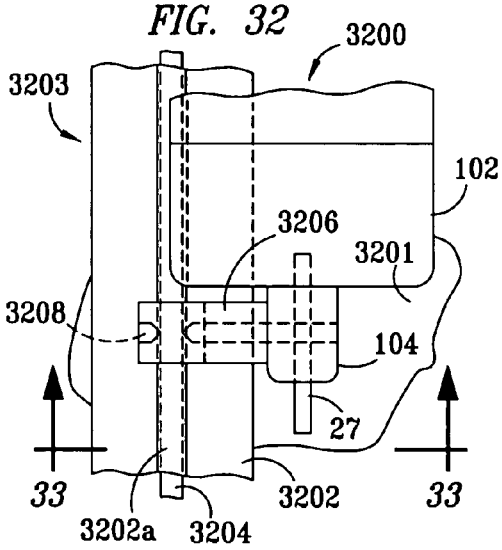
FIG. 32 is a plan view of an alternate embodiment of the invention adapted for use with an alternate embodiment of a guide.
Figure 33:
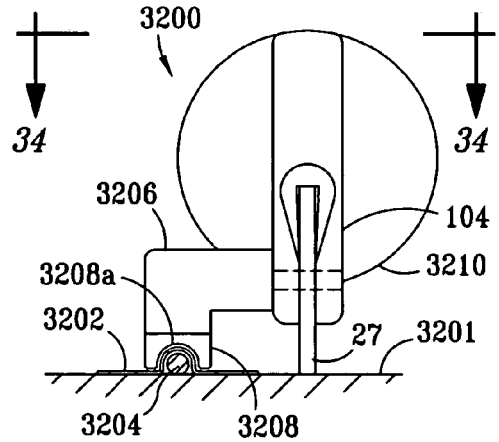
FIG. 33 is an end elevation view of the embodiment of FIG. 32 taken along the line 33-33 of FIG. 32.
Figure 34:
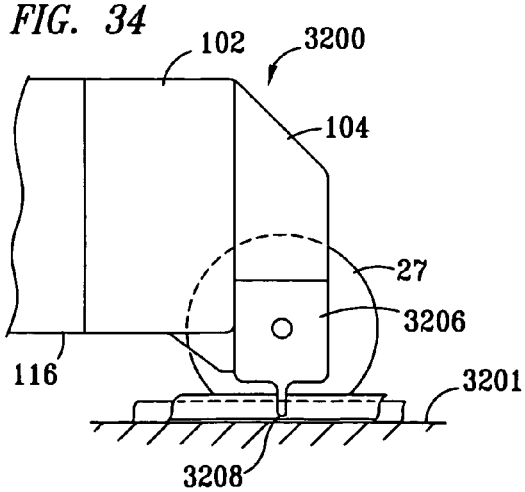
FIG. 34 is a side elevation view of the embodiment of FIG. 32 taken along the line 34-34 of FIG. 33.

The embodiment of FIG. 31 is similar to the embodiment of FIGS. 6-19, and identical components are given the same reference numerals. According to the embodiment of FIG. 31, a shoulder 3120 having a guide pin 3121 is similar to the shoulder 1502, but is additionally provided with teeth 3122 configured for engaging a ratchet 3124 extending from a main body 102. The ratchet 3124 is hingedly secured to the head 102 via a spring action mechanism well-known in the art, so that it may be disengaged from the teeth 3122, and the shoulder 3120 moved longitudinally along the axle 3123. An expansion plug 3104 is preferably positioned in the barrel 3102 for containing paint 3108 within the barrel, and a plunger, such as a dowel pin, is provided for applying pressure to the paint 3108 to thereby force the paint to the wheel 27. In operation, the head 102 is positioned on the barrel 3108, the barrel is filled with paint 3108, and the paint secured therein via the expansion plug 3104. The guide pin 3121 is then positioned in a guide, such as exemplified above with respect to FIGS. 9-11, and, while moving the tool 3100, force is applied via the plunger 3106 to the expansion plug 3104 to cause paint 3108 to flow over the wheel 27 and form a pin stripe. It may be appreciated that the embodiment of FIG. 31 lends itself to use as a disposable striper.

The embodiment of FIGS. 32-35 is similar to the embodiment of FIGS. 6-19, and identical components are given the same reference numerals. According to the embodiment of FIGS. 32-34, a guide 3203 preferably comprises thin foam or tape 3202 (e.g., conventional masking tape or the like) having removable adhesive (such as described above with respect to FIGS. 9-11) on one side, and a string, wire, or other such flexible line material 3204 extending longitudinally along the middle of the adhesive side of the tape 3202, to thereby form a raised longitudinal ridge 3202*a* in the tape. A shoulder 3206 extending from the head 104 comprises a recess portion 3208 defining a recess 3208*a* configured for matingly engaging the ridge portion 3202*a* of the guide 3202. The recess 3208*a* is preferably configured to make a point contact (as viewed in FIG. 32) with the ridge 3202*a*, to thereby facilitate movement of the recess 3208*a* about the ridge 3202*a* without becoming disengaged from the ridge. In operation, the guide 3203 is positioned on a surface 3201 of a vehicle (not shown) so that the ridge is adjacent to the desired location of a pin stripe, the recess 3208*a* is positioned over the ridge 3202*a* of the tape, and operation is otherwise substantially similar to the operation of the embodiment of FIGS. 1-31.

Figure 35:
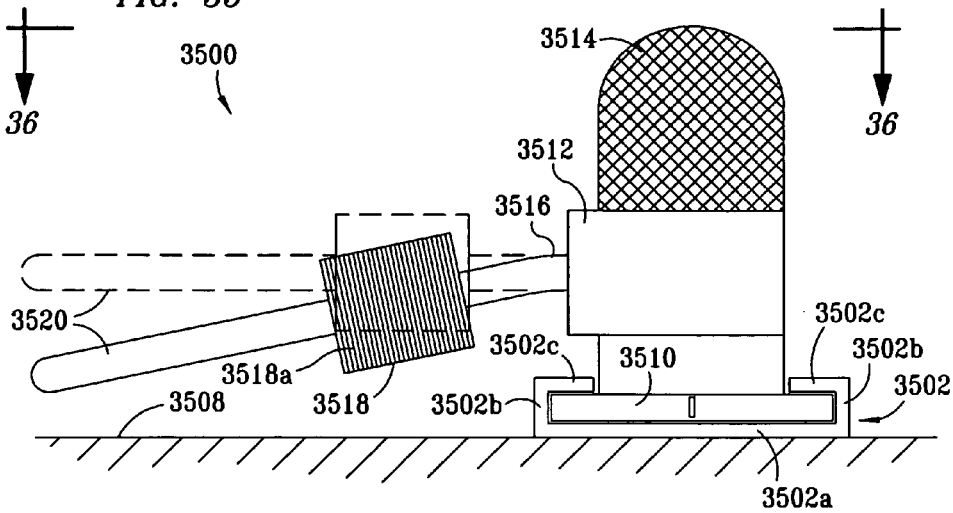
FIG. 35 is an elevation view of an alternative embodiment of a tracking mechanism of the present invention.
Figure 36:
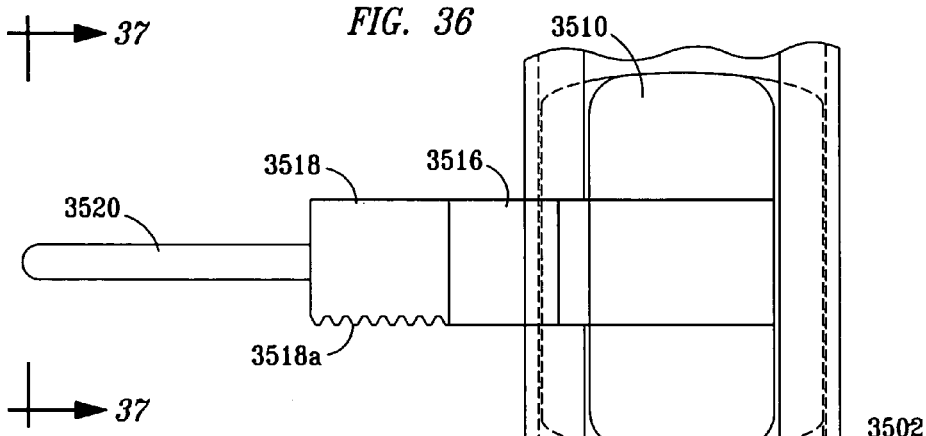
FIG. 36 is a plan view of the tracking mechanism of FIG. 35.
Figure 37:
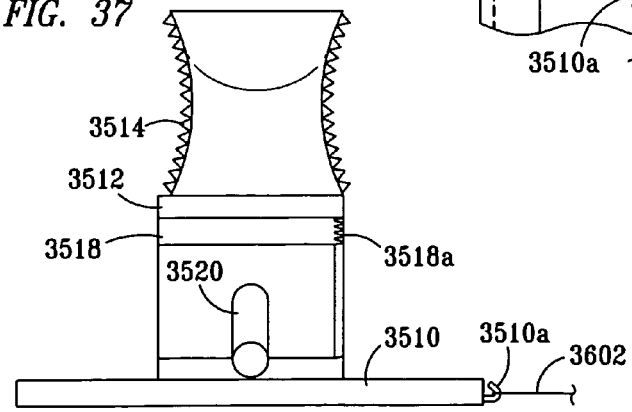
FIG. 37 is an alternative elevation view of the tracking mechanism of FIG. 35.

FIGS. 35-37 depict a tracking mechanism 3500 embodying features of the present invention. Accordingly, a guide 3502 is adhered to a vehicle surface 3508. As viewed in FIG. 35, the guide 3502 includes base portion 3502*a*, an upwardly extending portion 3502*b* extending upwardly from each of two edges of the base portion 3502*a*, and an inwardly extending portion 3502*c* extending inwardly from the top of each upwardly extending portion 3502*b*, so configured for slidably receiving a flange portion 3510 of the tracking mechanism 3500. As viewed in FIGS. 35 and 37, post portion 3512 extends upwardly, and a hand grip 3514 configured for being gripped by a user during operation extends upwardly from the post portion 3512. A preferably flexible cantilever 3516 extends outwardly from the post 3512. The cantilever 3516 includes a toothed portion 3518 extending from the cantilever, and a wheel axle 3520 extending from the toothed portion 3518. As viewed in FIG. 35, the flexible cantilever 3516 is configured so that the toothed portion 3518 and wheel axle 3520 are preferably canted slightly downwardly from horizontal, though, as indicated in dashed outline, the flexible cantilever 3516 may be flexed so that the toothed portion 3518 and wheel axle 3520 are rotated upwardly, even to a substantially horizontal position as shown in dashed outline in FIG. 35. As shown in FIGS. 36-37, the flange portion 3510 of the tracking mechanism 3500 preferably includes a connector, such as a hook, 3510 attached to either end of the flange 3510, to which connector a pulling member, such as a string, 3602 may be attached for pulling the flange portion 3510 along the guide 3502 during operation.

Figure 38:
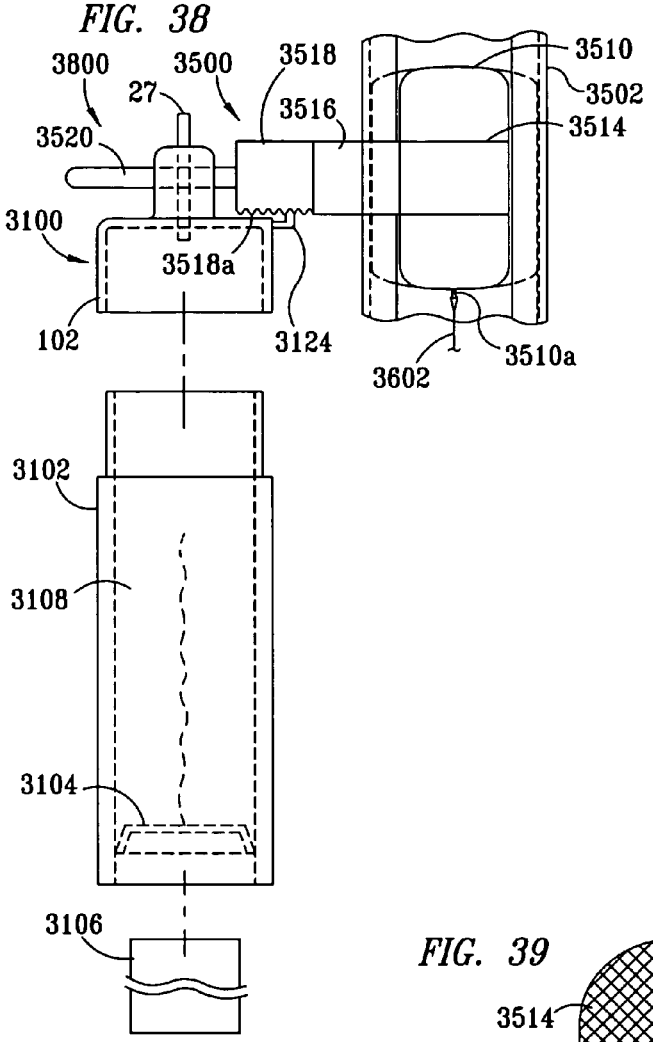
FIG. 38 is a plan view of the tracking mechanism of FIG. 35 coupled with a barrel and striping wheel.

FIG. 38 depicts the tracking mechanism 3500 of FIGS. 35-37 adapted for use with a pinstriping tool, exemplified by the pinstriping tool 3100 of FIG. 31. Accordingly, in the tool 3100, the tracking mechanism 3500 substitutes for the shoulder 3120, guide pin 3121, and axle 3123. The wheel 27 then rotates about the axle 3520, and is spaced apart from the guide 3502 by adjusting the engagement of the ratchet arm 3124 with the teeth 3518*a*, similarly as described above with respect to FIG. 31. Operation of the tool 3800 is similar to the operation of the tool 3100, but for placement of the flange 3510 within the guide 3502, and preferably the application of force on the string 3602 to facilitate movement of the tracking mechanism 3500 along the guide 3502. It may be appreciated that the flexible cantilever 3516 preferably urges the wheel 27 onto a vehicle surface 3508.

Figure 39:
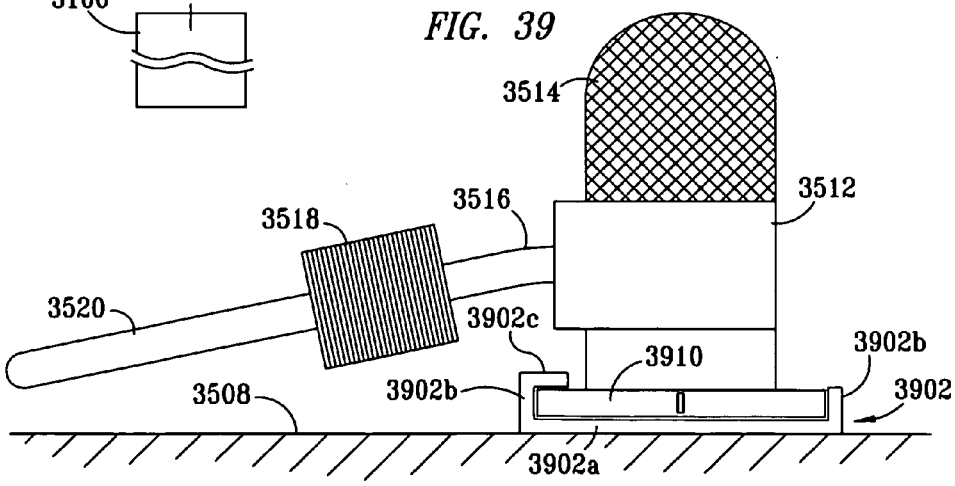
FIG. 39 presents the tracking mechanism of FIG. 35 having an alternative embodiment of a track.

FIG. 39 depicts an alternative embodiment 3900 of the tracking mechanism 3500, wherein the guide 3502 is replaced by a guide 3902, preferably having a base portion 3902*a*, an upwardly extending portion 3902*b* extending upwardly from each of two edges of the base portion 3902*a*, and an inwardly extending portion 3902*c* extending inwardly from one upwardly extending portion 3902*b*. In still further alternative embodiments, the guide 3902 may include one or two upwardly extending portions 3902*b*, with no inwardly extending portions 3902*c*. Operation of the tracking mechanism 3900 is similar to the operation of the tracking mechanism 3500, as discussed above with respect to FIG. 38.

Figure 40:
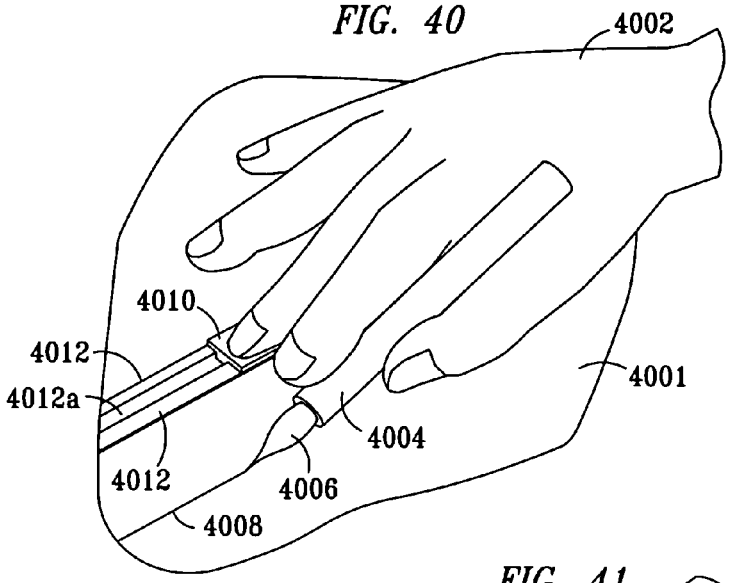
FIG. 40 is a perspective view of an alternate embodiment of the present invention adapted for application a pin stripe via a handheld paintbrush.
Figure 41:
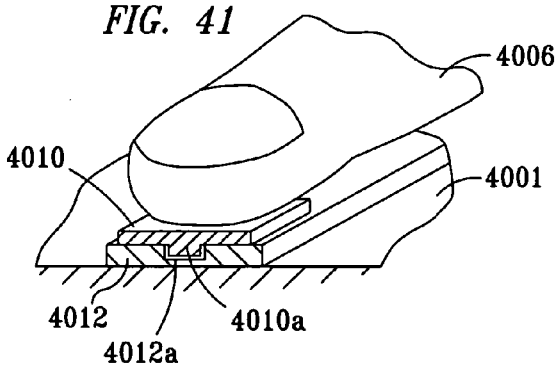
FIG. 41 is a perspective view showing detail of a finger guide.

The embodiment of FIGS. 40-41 depict a system and method for facilitating a freehand application of a pin stripe. Accordingly, a guide 4012 having adhesive on one side, as described above with respect to FIGS. 9-34, is preferably configured having a preferably square (or rectangular) groove 4012*a* formed longitudinally therein. A guide pad 4010 comprises a ridge 4010*a*, or alternatively, a round protrusion, configured for matingly engaging the groove 4012*a*. In operation, the ridge (or protrusion) 4010*a* of the guide pad 4010 is slidingly positioned in the groove 4012*a* of the guide 4012, and a user, while holding in his/her hand 4002 in a conventional manner a brush 4004 having bristles 4006 dipped in paint, positions a finger 4006 on the pad 4010. As the user's hand 4002 is being guided by the pad 4010 positioned in the groove 4012*a*, the user positions the bristles 4006 of the brush 4004 where a pin stripe is desired, and pulls his/her hand backwardly to thereby form the pin stripe.

Figure 42:
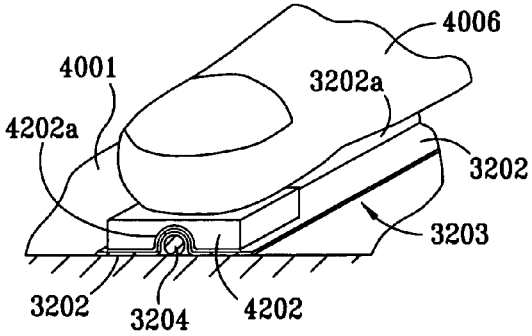
FIG. 42 is a perspective view showing detail of an alternate embodiment of the finger guide of FIGS. 40-41.

The embodiment of FIG. 42 is similar to the embodiment of FIGS. 40-41, and identical components are given the same reference numerals. Accordingly, a guide 3203 as described above with respect to FIGS. 32-34 is utilized in place of the guide 4012, and a guide pad 4202 is configured with a longitudinal recess 4202*a* for matingly engaging with the ridge 3202*a*. Operation of the embodiment of FIG. 42 is similar to the operation of the embodiment of FIGS. 40-41, but for slidingly engaging the recess 4202*a* with the ridge 3202*a*.

Figure 43:
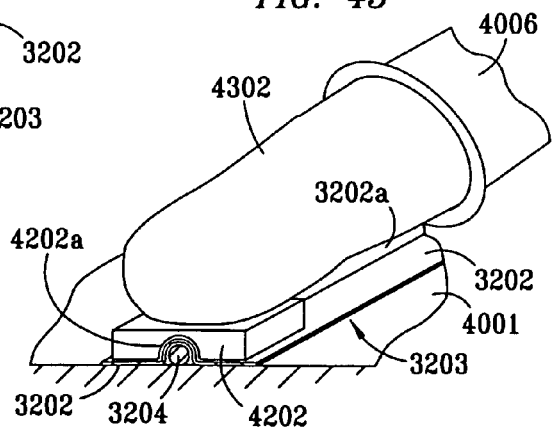
FIG. 43 is a perspective view showing detail of an alternate embodiment of the finger guide of FIG. 42.
Figure 44:
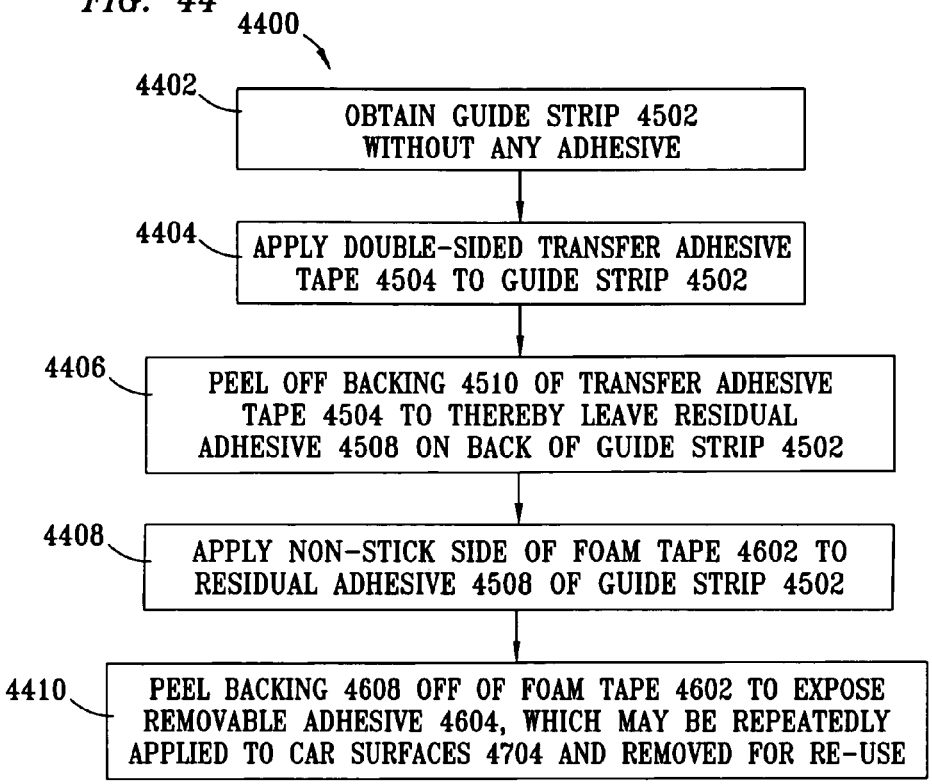
FIG. 44 is a flowchart of steps for assembling a guide in accordance with the present invention.
Figure 45:
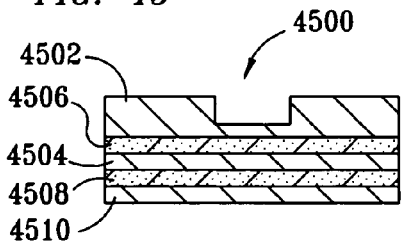
FIGS. 45-47 are cross-sectional elevation views of a guide during various phases of assembly according to the steps of the flow chart of FIG. 44.

The embodiment of FIG. 43 is similar to the embodiment of FIG. 42, and identical components are given the same reference numerals. Accordingly, a sheath 4302 is positioned over the user's finger 4006 to protect the finger. The sheath 4302 may be formed integrally with the guide pad 4202, or adhesive (not shown) may be provided for adhering the guide pad 4202 to the sheath 4302. Operation of the embodiment of FIG. 43 is similar to the operation of the embodiment of FIG. 42, but for utilizing the sheath 4302 on the user's finger 4006. It is noted that the sheath 4302 may also be utilized in conjunction with the embodiment of FIGS. 40-41.

FIGS. 44-47 exemplify one preferred method for assembling a guide, such as the guide 402 and strip 502 (FIGS. 9-11), using a foam adhesive layer. Accordingly, in step 4402, a user (not shown) obtains a guide 4502 (being used representatively of any guide, such as the guide 402), void of any adhesive. In step 4404, the user applies transfer (e.g., two-sided) adhesive tape 4504 (e.g., from 3M™), having adhesive 4506 on one side securing the tape 4504 to the guide 4502, and adhesive 4608 on an opposing side and protected by a removable backing 4510, both adhesive 4506 and 4508 being virtually identical conventional adhesive.

Figure 46:
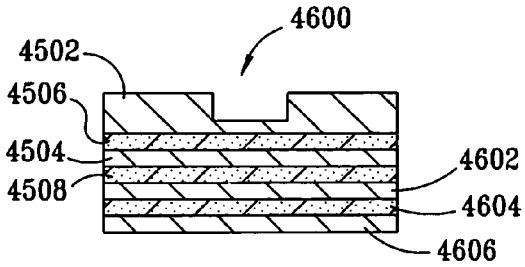

Referring to FIG. 46, in step 4406, the backing 4510 is removed from the transfer adhesive tape 4504, exposing the adhesive 4508 on one side of the tape 4504. In step 4408, a non-adhesive side of foam tape 4602 (available, for example, from PluStar™ in Dallas, Tex. is applied to the adhesive 4508. The foam tape 4602 includes, on a side opposite the adhesive tape 4504, a layer of adhesive 4604 adapted for removably adhering the guide 4504 (and adhesive tape 4504) to a surface of a vehicle. The adhesive 4604 is preferably effective within a temperature range of at least 40° to 160° Fahrenheit, and is preferably removable without leaving a residue on the surface of a vehicle. A backing layer 4606 is preferably applied to the adhesive 4604 to protect the adhesive 4604.

Figure 47:
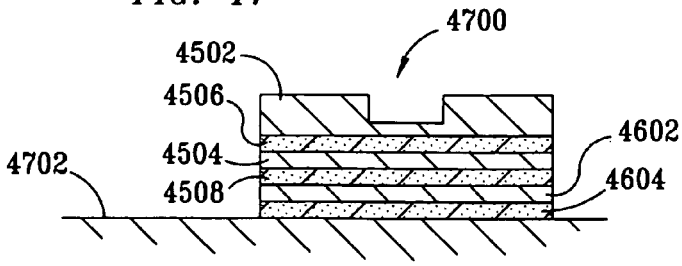

Referring to FIG. 47, in step 4410, the backing layer 4606 is removed from the foam tape 4602, exposing the adhesive 4604. The foam tape 4602, and with it the guide 4502, may then be positioned on and adhered to a surface 4702 of a vehicle, wherein the guide is substantially parallel to the desired position of the pinstripe. By virtue of the adhesive 4604 being characterized as removable, the guide 4502 may be removed and repeatedly applied and re-used to a number of car surfaces.

By the use of the present invention a pinstripe may applied to the surface of vehicle by persons, with or without substantial experience, in a reasonable amount of time with consistent high-quality. This advantage results in part from positioning a guide pin (e.g., 114) on a head (e.g., 104), rather than on the barrel as done in the prior art, thereby minimizing any effects of wavering during use of the invention.

It is understood that the present invention may take many forms and embodiments. Accordingly, several variations may be made in the foregoing without departing from the spirit or the scope of the invention. For example, the strip 502 may be fabricated from magnetic material for removably securing the strip and guide (e.g., 402) to a metallic surface of a vehicle. The guide (e.g., 402) may be fabricated from plastic. The tracks (e.g., 404 and 406) defined within the guide 402 and/or the guide pin (e.g., 114) may also be magnetized for facilitating travel of a guide pin within the tracks.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

The invention claimed is:

1. A pin striping tool configured for applying a pinstripe onto a vehicle, said tool comprising:

a main body having a head portion, an interior cavity, and a slot in fluid communication between the head portion and the interior cavity of said main body, said slot being configured for receiving a wheel, said interior cavity being configured for receiving paint;

a wheel rotatably mounted in said slot with a portion of the periphery of said wheel extending into said interior cavity;

a shoulder slidably extending from said main body, said shoulder including teeth;

a ratchet hingedly secured to, and extending from, said head portion of said main body, said ratchet being configured for engaging said teeth of said shoulder to secure the position of said shoulder relative to said main body;

a guide positionable on a surface of said vehicle, said guide having a strip comprising adhesive for removably adhering said guide to the surface of said vehicle; and a guide pin extending from said shoulder, said guide pin being configured for riding at least one guide track formed in said guide, said at least one track defining a groove and being substantially parallel to the desired position of said pinstripe.

2. The pin striping tool of claim 1 further comprising a spring action mechanism coupled to said ratchet for urging said ratchet in engagement with said teeth.

* * * * *